US006508262B1

(12) United States Patent
Takayama

(10) Patent No.: US 6,508,262 B1
(45) Date of Patent: Jan. 21, 2003

(54) FOLDING TENT FRAME

(75) Inventor: Toshihiko Takayama, Hirakata (JP)

(73) Assignee: San-E-Protent Co., Ltd. (JP)

( * ) Notice: Subject to any disclaimer, the term of this patent is extended or adjusted under 35 U.S.C. 154(b) by 55 days.

(21) Appl. No.: 09/688,177

(22) Filed: Oct. 16, 2000

(30) Foreign Application Priority Data

Apr. 5, 2000 (JP) ..... 2000-103564

(51) Int. Cl.[7] ..... E04H 15/50

(52) U.S. Cl. ..... 135/145; 135/142; 135/146; 135/114; 135/908; 135/912

(58) Field of Search ..... 135/97, 145, 146, 135/151, 908, 85, 114, 116, 141, 142, 912

(56) References Cited

U.S. PATENT DOCUMENTS

| | | | | | |
|---|---|---|---|---|---|
| 4,607,656 A | | 8/1986 | Carter | | |
| 4,641,676 A | | 2/1987 | Lynch | | |
| 4,779,635 A | | 10/1988 | Lynch | | |
| 4,885,891 A | | 12/1989 | Lynch | | |
| 4,947,884 A | | 8/1990 | Lynch | | |
| 5,244,001 A | | 9/1993 | Lynch | | |
| 5,275,188 A | | 1/1994 | Tsai | | |
| 5,421,356 A | | 6/1995 | Lynch | | |
| 5,634,483 A | * | 6/1997 | Gwin | 135/131 | |
| 5,806,549 A | * | 9/1998 | Love | 135/143 | |
| 6,089,247 A | * | 7/2000 | Price | 135/145 | |
| 6,112,757 A | * | 9/2000 | Tseng | 135/145 | |
| 6,148,835 A | * | 11/2000 | Rhee | 135/145 | |
| 6,240,940 B1 | * | 6/2001 | Carter | 135/145 | |

* cited by examiner

*Primary Examiner*—Yvonne M. Horton
(74) *Attorney, Agent, or Firm*—Griffin & Szipl, P.C.

(57) ABSTRACT

A folding tent frame for collapsible tents includes upright pole sets, fixed couplers, stoppers, movable couplers and traverse frame members. Specifically, each stopper is provided on the uppermost pole of the upright pole set at a position lower than the fixed coupler so as to prevent the lower pole of the upright pole set from moving up beyond the stopper and so that the movable coupler is slidable over the stopper and the lowest pole of the upright pole set, and is kept from moving up beyond the stopper. The lower pole is larger than the upper pole in cross section. The structure of this folding tent frame provides improved strength and stability.

18 Claims, 11 Drawing Sheets

FOLDING TENT FRAME

BACKGROUND OF THE INVENTION

1. Field of the Invention

The present invention relates to improvements in folding tent frames for foldable or collapsible tents used as a protection against the rain or sun or the like.

2. Description of the Related Art

Folding tent frames are disclosed, for example, in Japanese Pat. Nos. 2597670, 2625255, 2836956, 2949648; unexamined Japanese patent application No. 1-142183, unexamined PCT patent application (published in Japan) 10-503249; registered utility model Nos. 3057222, 3057223; U.S. Pat. Nos. 4,607,656; 4,641,676; 4,779,635; 4,885,891; 4,947,884; 5,244,001; 5,275,188; 5,421,356.

These folding tent frames are essentially made up of telescopic expandable sets of poles, each set having at least two poles—a lower pole and an upper pole—the lower pole smaller than the upper pole in diameter; fixed couplers put at the top of the upper poles; movable couplers put on the upper poles at a position lower than the fixed couplers; and traverse frame members joined in a foldable scissor manner to the fixed couplers and the movable couplers.

In these folding tent frames, the upper pole is usually larger in diameter and the movable coupler can slide along the upper pole alone. This simplifies the construction of the folding tent frame.

However, the problem with these prior art frames is that while the construction is simple, these frames are poor in strength and stability because the lower pole is smaller in diameter.

SUMMARY OF THE INVENTION

In view of the disadvantages of the prior art, it is an object of the present invention to provide a folding tent frame with improved strength and stability.

The folding tent frame according to the present invention essentially comprises telescopically expandable sets of poles, each set having at least two poles—an upper pole and a lower pole—the upper pole is smaller than the lower pole in diameter; fixed couplers are disposed at the top of the upper poles; stoppers put on the upper pole at a position lower than the fixed couplers that prevent at least the lowest poles from moving up and can be juxtaposed and continuous with the lowest pole; movable couplers are slidably disposed on the stopper and the lower pole and kept by the stopper from moving up; and traverse frame members joined to a fixed coupler and a movable coupler in a foldable, scissor manner.

To set up the folding-type or collapsible tent frame, the movable coupler is fit over the stopper that limits upward movement of the movable coupler and the upper pole is pulled out from the lower pole.

When the folding-type or collapsible tent frame is folded, the upper pole is withdrawn into the lower pole and at least the lower pole is kept by the stopper from moving up. The lower pole is juxtaposed and continuous with the stopper so that the movable coupler is slid from the stopper down the lower pole. At this point, the lower pole and the stopper come into contact and are continuous with each other, permitting the movable coupler to slide smoothly between them.

It is noted that since the lower pole is larger than the upper pole in diameter, the upright pole set is high in buckling strength and improved in stability, too.

In a preferred embodiment, the upright pole set is formed of two poles—an upper pole and a lower pole. This makes it possible to build an expandable upright pole set with the least number of poles.

In another preferred embodiment, the upright pole set is formed of three poles—an upper pole, a middle pole and a lower pole. This makes it possible to build an expandable upright pole set with a low number of poles—an upright pole set that is long in extended length and short in withdrawn length.

The traverse frame member is preferably square in cross section. This construction evenly distributes the load from above or from the side, thus reducing the twisting of the whole folding tent frame and reducing the weight of the tent frame itself.

It is desirable that the second lowest pole (i.e., the middle pole in a three-pole embodiment or the upper pole in a two-pole embodiment) be provided with a wheel that projects from the lowest pole and comes in contact with the ground when the poles are withdrawn. The wheel facilitates moving the folding tent frame when the poles are withdrawn. When the poles are extended, the wheel withdraws from the bottom pole. The bottom pole can be securely grounded.

It is desirable to provide a movable coupler fastening means between the stopper and the movable coupler—means to fasten the movable coupler to the stopper. That can prevent the movable coupler from moving down inadvertently.

It is also desirable to provide an extended pole fastening means to keep the upright pole set in an extended state. This can prevent the upright pole set from contracting inadvertently.

It is desirable to provide a withdrawn pole fastening means between the poles that keeps the withdrawn poles fixed and an elastic body to push up the upper pole out of the lower pole. According to this arrangement, when the withdrawn pole fastening means is disengaged, the upper pole can extend from the lower pole by the elastic body, a spring, for example. That lightens the labor of expanding the poles in setting up the folding frame.

It is desirable that the traverse frame member be integrally provided with washers at the end of the traverse frame member. This saves the trouble of inserting a washer every time the frame is set up, and facilitates setting up.

It is desirable that the movable coupler fastening means includes an engaging hole on the pole; a latch provided on the movable coupler that can be put into the engaging hole; a spring to bias the latch toward the engaging hole; and holding means for keeping the latch in a disengaged position. In this arrangement, the latch can be kept in a disengaged position by the holding means, and this makes it easy to move the movable coupler up or down.

It is further desirable that the movable coupler fastening means includes an engaging hole on the pole; a latch provided on the movable coupler that can be put into the engaging hole; a spring to bias the latch toward the engaging hole; and an inclined surface provided on the latch, wherein the inclined surface moves the latch to the disengaging position as it comes in contact with the lower pole. According to this arrangement, it is possible to hold the latch in a disengaged position by utilizing the contracting movement of the lower pole. That is, with no special procedures, the movable coupler can be raised.

Further objects, features and advantages of the present invention will become apparent from the Detailed Description of Preferred Embodiments, which follows, when read along with the attached Drawings.

DESCRIPTION OF THE PREFERRED EMBODIMENTS

Figure 1A:
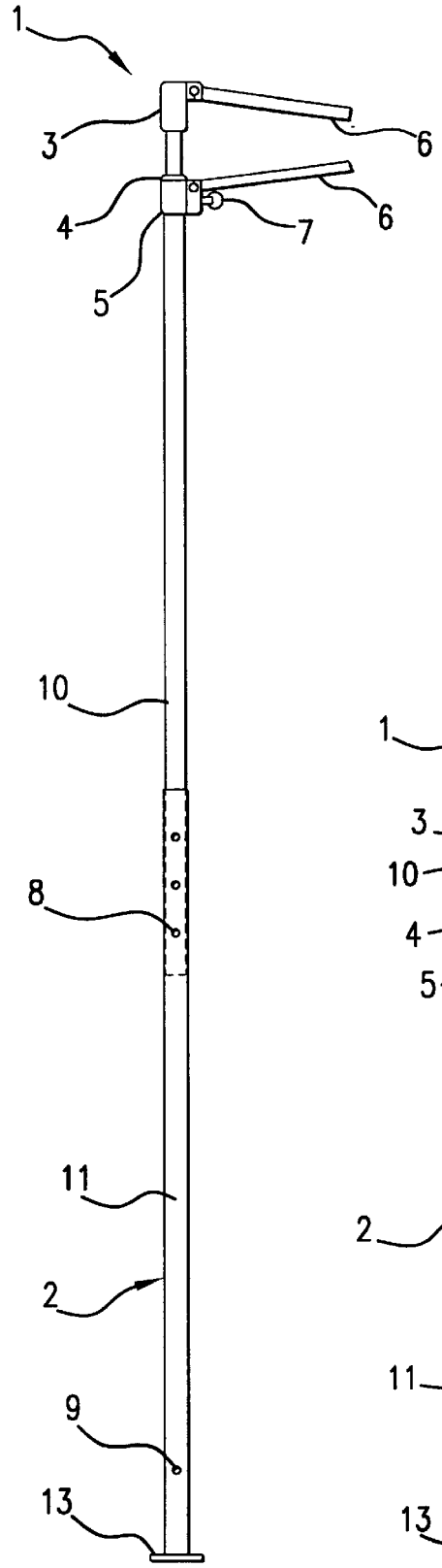
FIGS. 1(*a*), (*b*) and (*c*) are side views of a first embodiment of a folding tent frame according to the present invention, with the frame set up in 1(*a*), the poles withdrawn in 1(*b*) and the poles folded in 1(*c*).

Certain preferred embodiments of the present invention will now be described with reference to the Figs. in which like parts are represented by like reference numerals.

EXAMPLE 1

The folding tent frame 1, according to the first embodiment of the present invention, essentially comprises upright pole sets 2, fixed couplers 3, stoppers 4, movable couplers 5, traverse frame members 6, movable coupler fastening means 7, extended pole fastening means 8 and withdrawn pole fastening means 9.

The upright pole set 2 is made up of at least two poles, an upper pole and a lower pole. The lower pole is larger than the upper pole in diameter, and fits over the upper pole and expands like a hand telescope. In this example, the poles, upper pole 10 and lower pole 11, are made of metal pipe with a cross-section. The lower pole 11, which is larger in cross-section, fits over and slides over the upper pole 10.

The upper pole 10 is provided with a sliding piece 12 made of a synthetic resin, such as nylon or other suitable material, over the outside surface of a lower section which slides on the inside surface of the lower pole 11. The lower pole 11 is also provided with the same sliding piece 12 over the inside surface of an upper section, which slides on the outside surface of the upper pole 10.

The lower pole 11 is provided with a grounding plate 13. The grounding plate 13 has a drain hole 14 in the middle.

The fixed coupler 3 is put at the top of the upper pole 10 of the upright pole set 2. In this example, the fixed coupler 3 is molded of a synthetic resin and is made up of a pipe portion 15 to be fit over the top of the upper pole 10 and two pairs of right and left brackets 16 that are attached to the top thereof.

The pipe portion 15 is clamped to the upper pole 10 by a fastener 17 like a tapping screw and prevented from slipping out.

The stopper 4 is provided on the upper pole 10 of the upright pole set 2 at a point below the fixed coupler 3. The stopper 4 keeps the lower pole 11 of the upright pole set 2 from moving up beyond that, and can be juxtaposed and continuous with the upper pole 10. In this example, the stopper 4 is made of a synthetic resin and made up of a pipe sleeve 18 that fits over the upper pole 10 and a flange 19.

The flange 19 is fixed on the upper pole 10 by a fastener 20, such as a knock pin, and stopped from moving.

The movable coupler 5 is so configured as to slide on the stopper 4 and the lower pole 11 of the upright pole set 2 and is stopped by the stopper 4 from moving up beyond that. In this example, the movable coupler 5 is molded of a synthetic resin and is made up of the pipe portion 21 slidable loosely over the stopper 4 and the lower pole 11, a plurality of pairs (two pairs) of right and left brackets 22 that are attached to the top of the movable coupler 5.

The pipe portion 15 of the fixed coupler 3 and the pipe portion 21 of the movable coupler 5 are provided with attaching means 23, such as hook & loop fasteners. The attaching means 23 is mated with an equivalent provided on the tent (not shown) for quick attachment or detachment.

Traverse frames 6 are joined to the fixed coupler 3 and also the movable coupler 5 in a foldable scissor form. In this example, the traverse frame members are made of metal pipe with a square cross section. Each pair of pieces is arranged in an X shape with the intersection pivoted by a pin 24. The ends of the traverse frame members are sandwiched between the brackets 16 of the fixed coupler 3 or between the brackets 22 of the movable coupler 5 and are pivoted on a horizontal axis 25 as by a tapping screw, thus allowing the traverse frame members to incline upward or downward.

Spacers (washers) are placed between the two traverse frame members 6 at their intersecting point.

Figure 6:
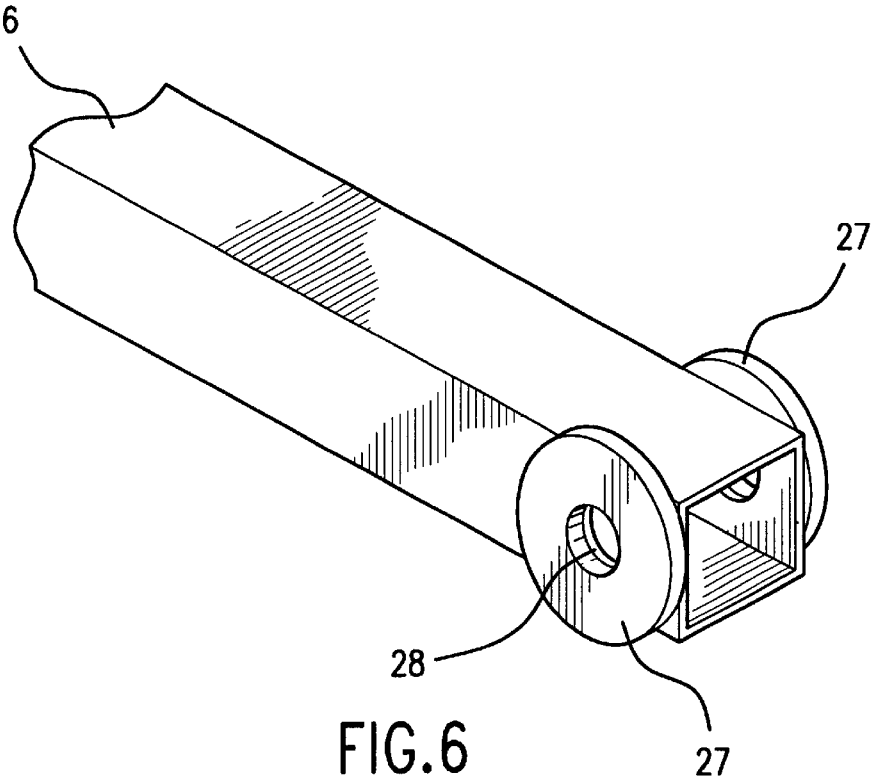
FIG. 6 is a perspective view of the traverse frame member.

On the two sides of the end of each traverse frame member 6, washers 27 are integrally fixed, such as by welding, and, as shown in FIG. 6, there is provided a through hole 28 for the horizontal axis 25 to pass through from the holes of the washers 27.

The movable coupler fastening means 7 is provided between the stopper 4 and the movable coupler 5 to fix the movable coupler 5 on the stopper 4. In this example, the movable coupler fastening means 7 includes an engaging hole 29 which passes the stopper 4 and the upper pole 10, a latch 30 provided on the movable coupler 5 to engage with the engaging hole 29, a spring 31 that presses the latch 30 into the engaging hole 29 and holding means 32 that holds the latch 30 in the disengaged position.

At the outside end of the latch 30, there is provided a ring 33 for a finger.

The holding means 32 is made up of a projection 34 which is formed on the side of the latch 30 and is to rest on part-of the movable coupler 5 when the latch 30 is turned axially in the disengaged position, and a groove 35 which is provided on the movable coupler 5 and allows the projection 34 to pass through.

The extended pole fastening means 8 is provided between two poles to fix those poles in an extended state. In this example, the extended pole fastening means 8 comprises a holding hole 36 provided at the lower portion of the upper pole 10, a plurality of (three in this embodiment) engaging holes 37 provided in the upper part of the lower pole 11 at a specific interval, a knob 38 that protrudes through the holding hole 36 and engages with one of the engaging holes 37, and a leaf spring 39 to thrust the knob 38 into the engaging hole 37.

The withdrawn pole fastening means 9 is provided between two poles to maintain those poles in a withdrawn state. In this example, the withdrawn pole fastening means 9 is constructed utilizing the extended pole fastening means 8. The withdrawn pole fastening means 9 comprises the holding hole 36, knob 38 and leaf spring 39 of the extended pole fastening means 8, and the single engaging hole 40 which is provided in the lower portion of the lower pole 11 so as to be engaged with the knob 38 of the extended pole fastening means 8.

The manner of operation of those arrangements just described will now be explained.

Figure 1B:
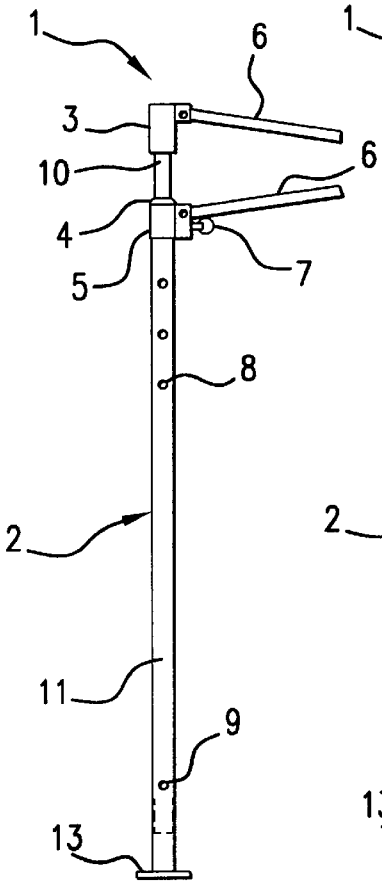
Figure 1C:
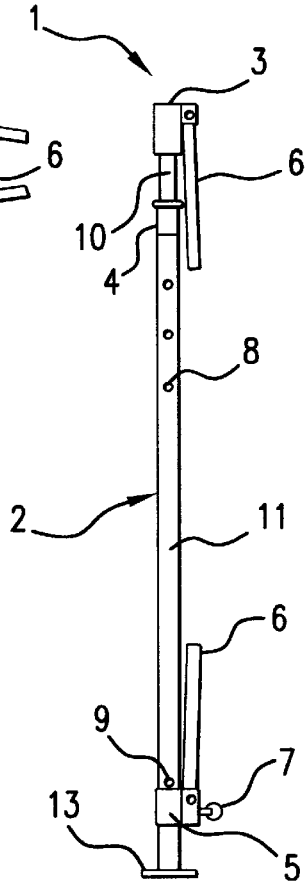

When the folding tent frame 1 is extended, the movable coupler 5 is fit over the stopper 4 as shown in FIG. 1. The flange 19 of the stopper 4 prevents the movable coupler 5 from going up beyond that. The lower pole 11 is drawn out from the upper pole 10.

When the movable coupler 5 comes to rest on the stopper 4, the projection 34 of the movable coupler fastening means 7 is fit into the groove 35, and the spring 31 forces the tip of the latch 30 to engage the engaging hole 29. Thus, the movable coupler fastening means 7 is put in an engaged position, and the movable coupler 5 is kept from moving down. The folding frame is held in a setup state.

Figure 2:
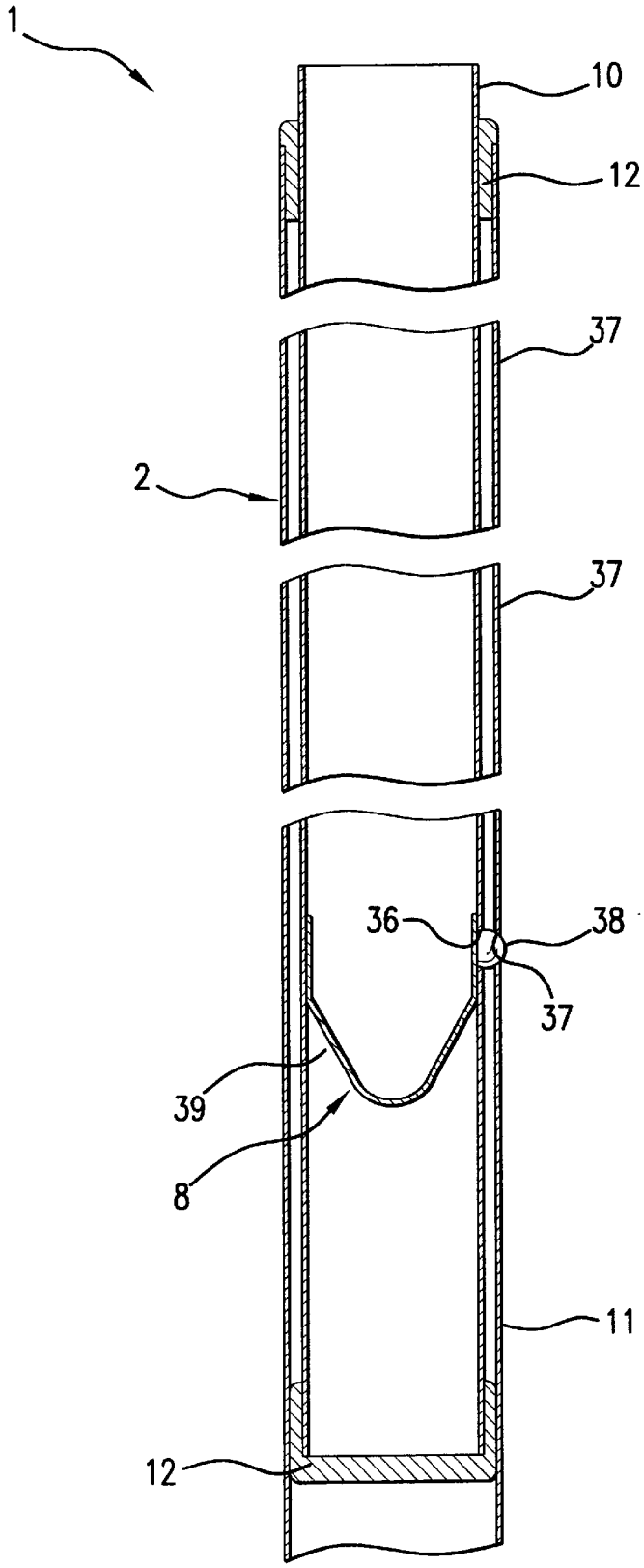
FIG. 2 is a vertical sectional view of a middle part of the frame in FIG. 1(*a*).
Figure 3:
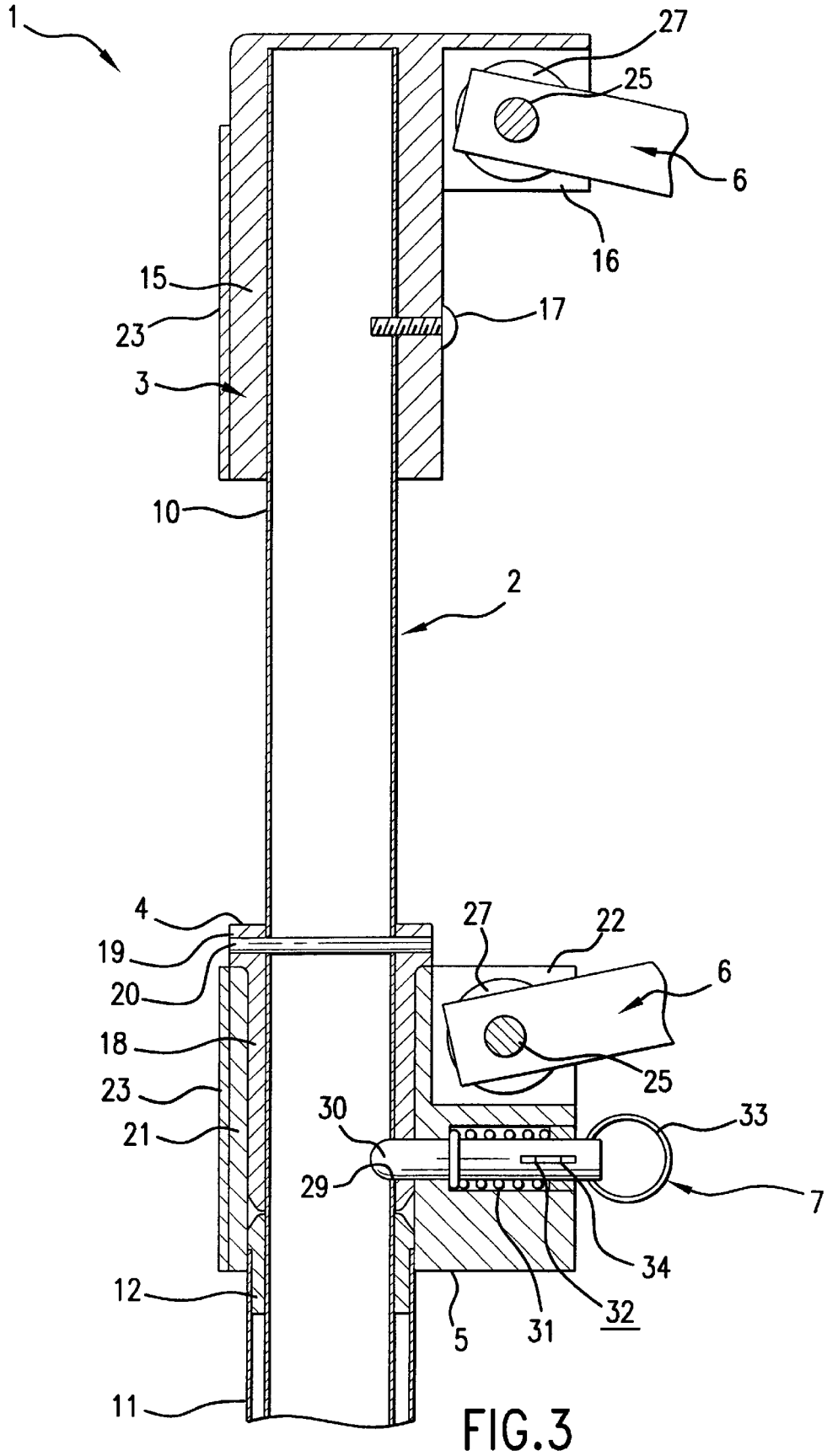
FIG. 3 is a vertical sectional view of an upper part of the frame in FIG. 1(*b*).
Figure 4:
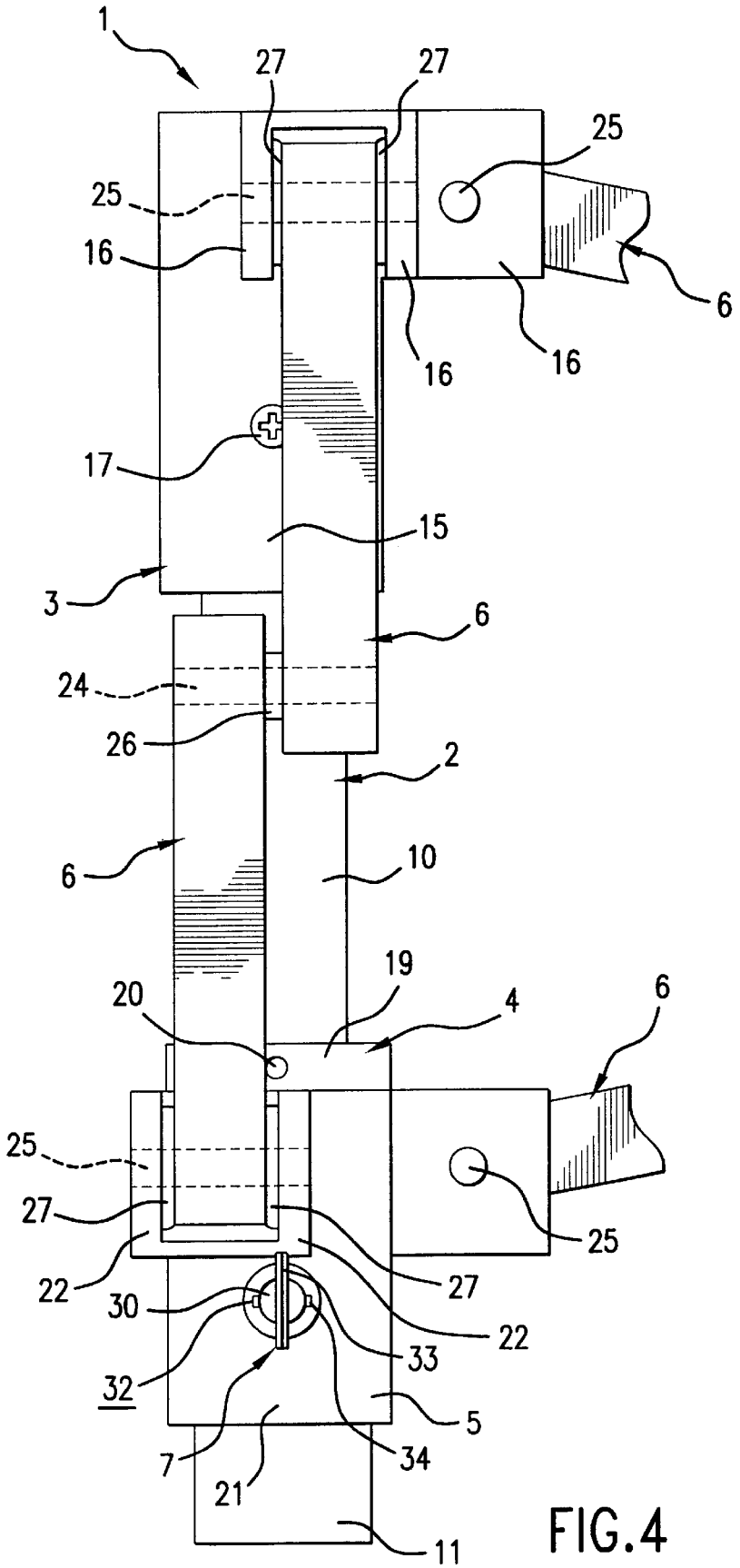
FIG. 4 is a front view of the section shown in FIG. 3.

When the upper pole 10 is drawn out from the lower pole 11, the knob 38 of the extended pole fastening means 8 is forced to engage one of the engaging holes 37 by the leaf spring 39 as shown in FIG. 2. Thus, the extended pole fastening means 8 is put in an engaged position when the upright pole set 2 is extended. The whole length of the upright pole set 2 can be adjusted by engaging the knob 38 of the extended pole fastening means 8 with a different engaging hole 37.

To collapse the folding tent frame, the movable coupler fastening means 7 is put in the disengaged position, and the upper pole 10 is withdrawn into lower pole 11 as shown in FIG. 1(*b*). With the stopper 4 keeping the lower pole 11 from moving upward further, the stopper 4 is juxtaposed and continuous with the lower pole 11. The movable coupler 5 is slid from the stopper 4 down to the lower end of the lower pole 11 as shown in FIG. 1(*c*).

To put the movable coupler fastening means 7 in the disengaged position, the latch 30 is pulled with a finger placed in the ring 33 and turned by a certain angle. Then, the projection 34 gets out of the groove 35 and rests on the end face of the movable coupler 5. In this way, the latch 30 is put in a disengaged position from the engaging hole 29 as shown in FIG. 5.

Figure 5:
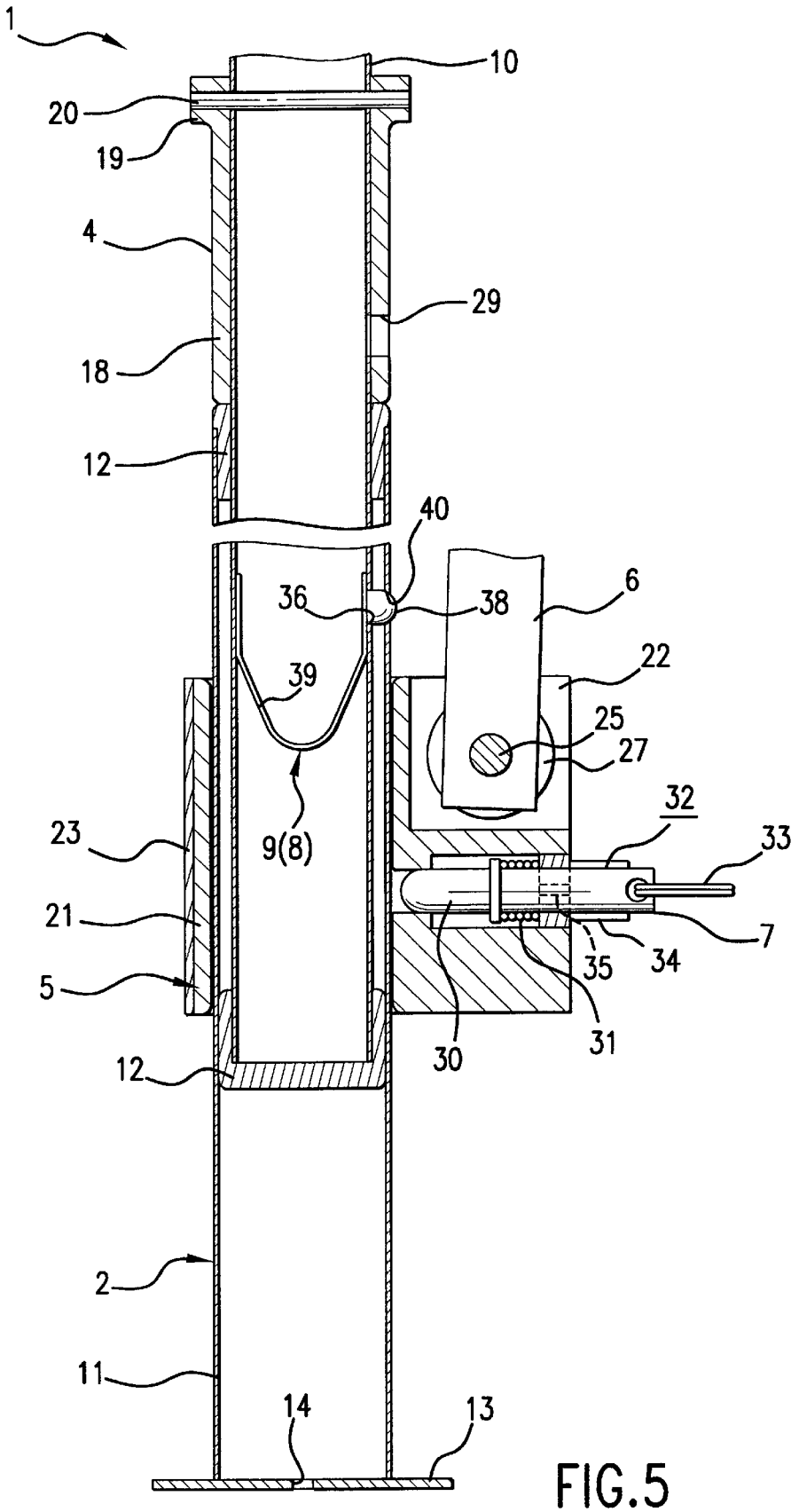
FIG. 5 is a vertical sectional view of the lower part of the frame in FIG. 1(*c*).

The upper pole 10 is withdrawn into the lower pole 11 and the knob 38 of the withdrawn pole fastening means 9 is forced by the leaf spring 39 to engage with the engaging hole 40 as shown in FIG. 5. Thus, the withdrawn pole fastening means 9 is put in an engaged position, and the upright pole set 2 is held in a withdrawn state.

The stopper 4 is in contact with, and continues with, the lower pole 11 as shown in FIG. 5, and that allows the movable coupler 5 to slide from the stopper 4 to the lower pole 11 smoothly. The withdrawn pole fastening means 9 is temporarily freed and disengaged with its knob 38 hitting the movable coupler 5 while the coupler 5 passes over that. But after that, the withdrawn pole fastening means 9 is immediately restored to the engaged position.

The upright pole set 2 is excellent in resistance to buckling and the like and improved in stability, too, because the lower pole 11 is larger than the upper pole 10 in cross section.

EXAMPLE 2

Figure 7:
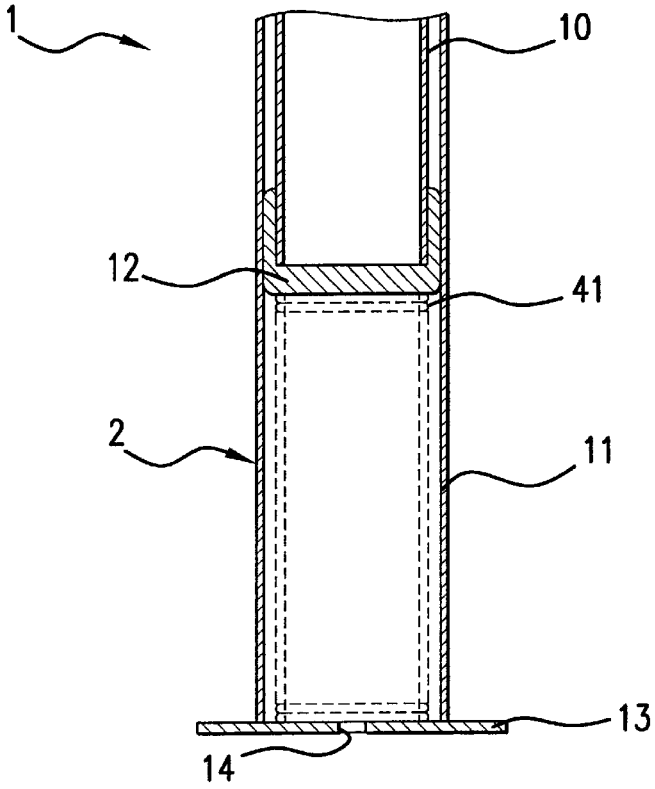
FIG. 7 is a vertical sectional view of an essential part of a second embodiment of a folding tent frame according to the present invention.

A second embodiment of the present invention will now be explained with reference to FIGS. 7 and 5.

In the second example, in addition to the withdrawn pole fastening means 9 to hold the upright pole set 2 in the withdrawn position, there is provided an elastic body 41, such as a spring, to expand the upper pole 10 from the lower pole 11. Except for that, the second embodiment is identical to the first example.

These arrangements are helpful in the following way. When the upright pole set 2 is withdrawn, the contracted or withdrawn state is maintained by the withdrawn pole fastening means 9. When the withdrawn pole fastening means 9 is disengaged, the elastic body 41 forces the upper pole 10 to spring up from the lower pole 11. That saves labor and a weak person could handle the tent frame without difficulty.

EXAMPLE 3

Figure 8:
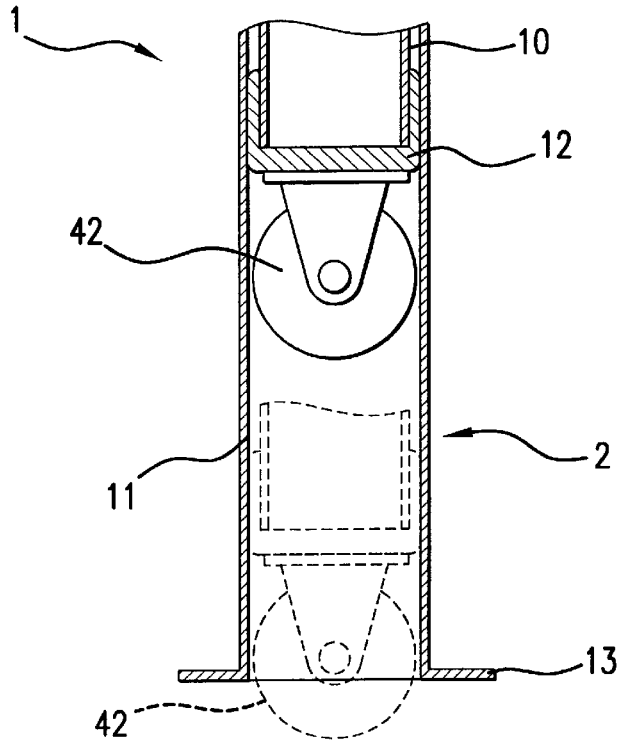
FIG. 8 is a vertical sectional view of an essential part of a third embodiment of a folding tent frame according to the present invention.

Now, a third embodiment of the present invention will be described with reference to FIG. 8.

In this example, a wheel 42 is provided at the lower end of the upper pole 10 so that the wheel 42 projects out and comes in touch with the ground when the poles are withdrawn. The grounding plate 13 has a hole that communicates with the inside of the lower pole 11. Other than that, this embodiment is the same as the first example.

These arrangements are helpful in the following way. When the upright pole set 2 is withdrawn, the wheel 42 projects from the lower pole 11 and facilitates the movement of the frame. When the poles are expanded, the wheel 42 withdraws from the lower pole 11 and does not interfere with the installation, and the grounding plate 13 of the folding tent frame 1 can be grounded securely.

EXAMPLE 4

Figure 9:
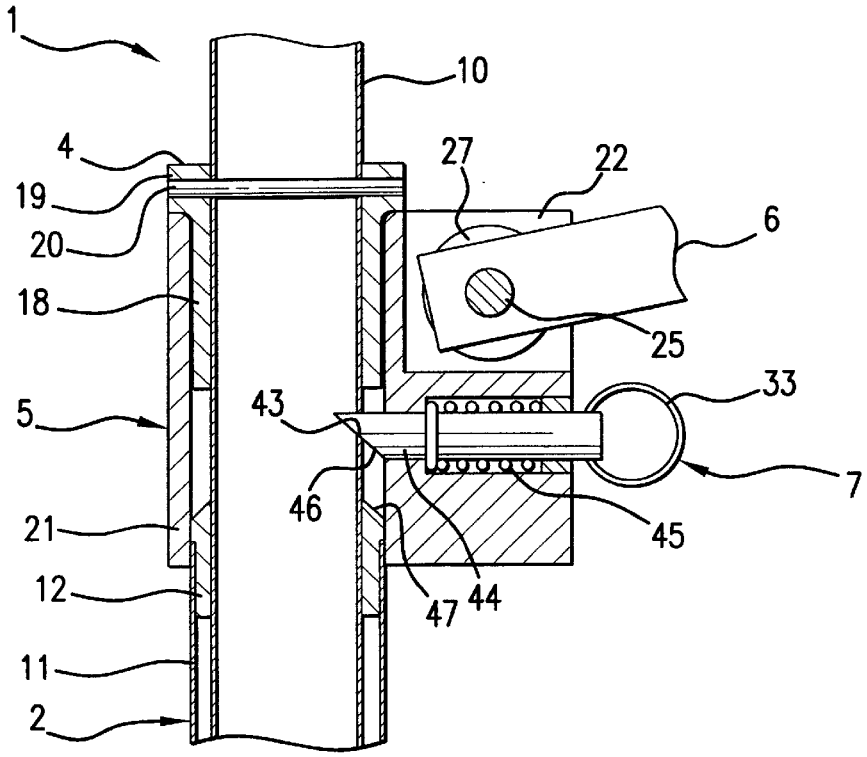
FIG. 9 is a vertical sectional view of an essential part of a fourth embodiment of a folding tent frame according to the present invention.

Now, a fourth embodiment of the present invention will be described with reference to FIG. 9.

In this example, the movable coupler fastening means 7 includes an engaging hole 43 provided on the upper pole 10; a latch 44 that is provided on the movable coupler 5 and can be engaged with the engaging hole 43; a spring 45 that presses the latch 44 for engagement; and an inclined surface 46 which is provided on the latch 44 and is pressed by the lower pole 11 such that the latch 44 is in the disengaged position.

The latch 44 is square in section and kept from making an axial turn. On the sliding piece 12 provided at the upper portion of the lower pole 11, there is formed an inclined surface 46 that is matched with the inclined surface 47. Except for those, the example is the same as the first embodiment.

In these arrangements, the contracting movement of the lower pole 11 can release the latch 44. That is, it is possible to draw up and down the movable coupler 5 without any special procedure.

EXAMPLE 5

Figure 13:
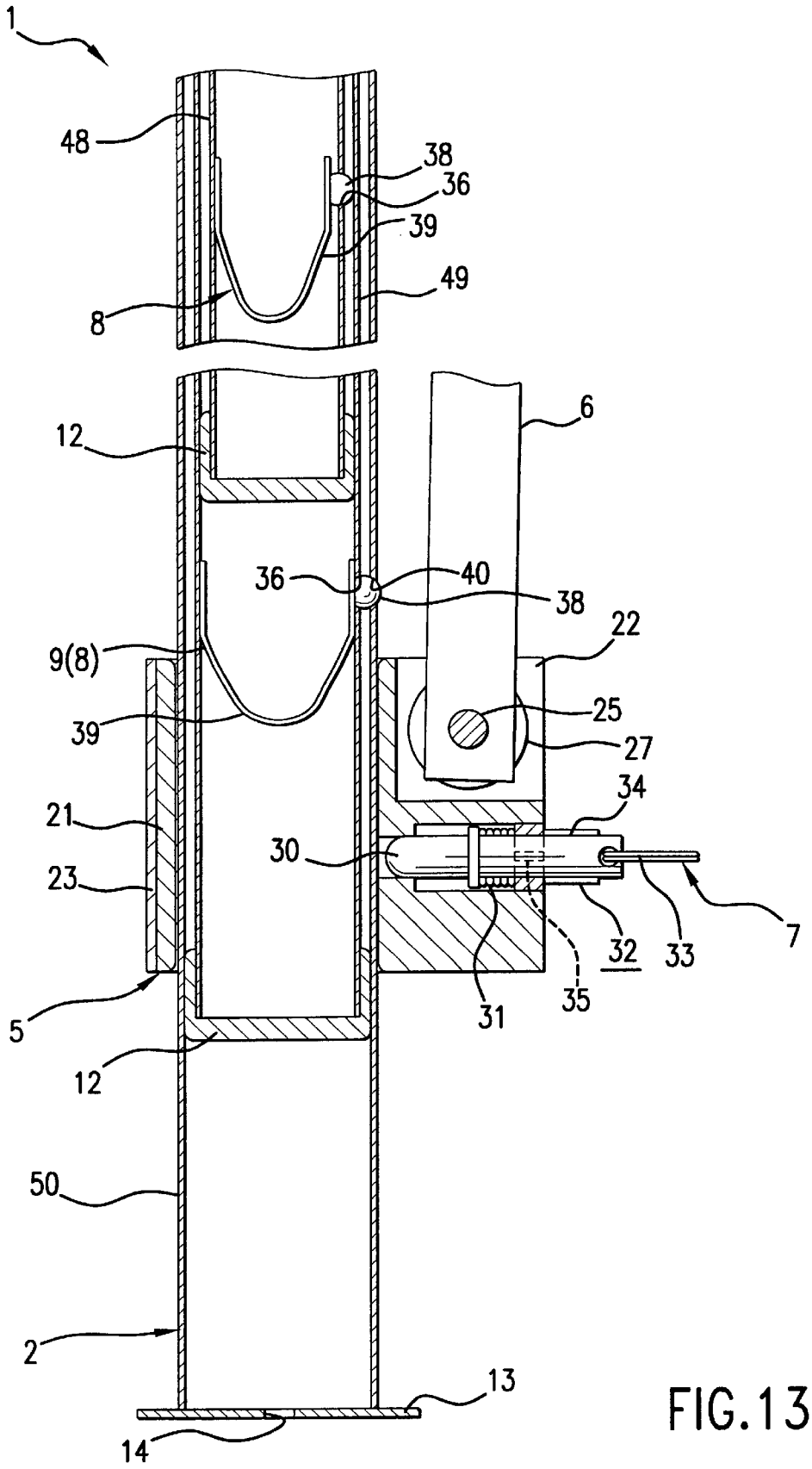
FIG. 13 is a vertical sectional view of the lower part of the frame shown in FIG. 10(*c*).

Now, a fifth embodiment of the present invention will be described with reference to FIGS. 10 and 13.

In the fifth example, the upright pole set 2 is formed of three poles—upper pole 48, middle pole 49 and lower pole 50.

The middle pole 49 and the lower pole 50 are kept from moving upward beyond stoppery 4 when they are in a withdrawn position. The movable coupler 5 is slidable onto the stopper 4 and over the lower pole 50. For the movable coupler fastening means 7, there is provided an engaging hole 29 on the stopper 4 only. The extended pole fastening means 8 are provided between the upper pole 48 and the middle pole 49 and also between the middle pole 49 and the lower pole 50. The withdrawn pole fastening means 9 is provided between the middle pole 49 and the lower pole 50. As in the first example, the extended pole fastening means 8 provided between poles 49, 50 is utilized as the means 9. In points other than the above, the present embodiment is identical with the first example.

Figure 10A:
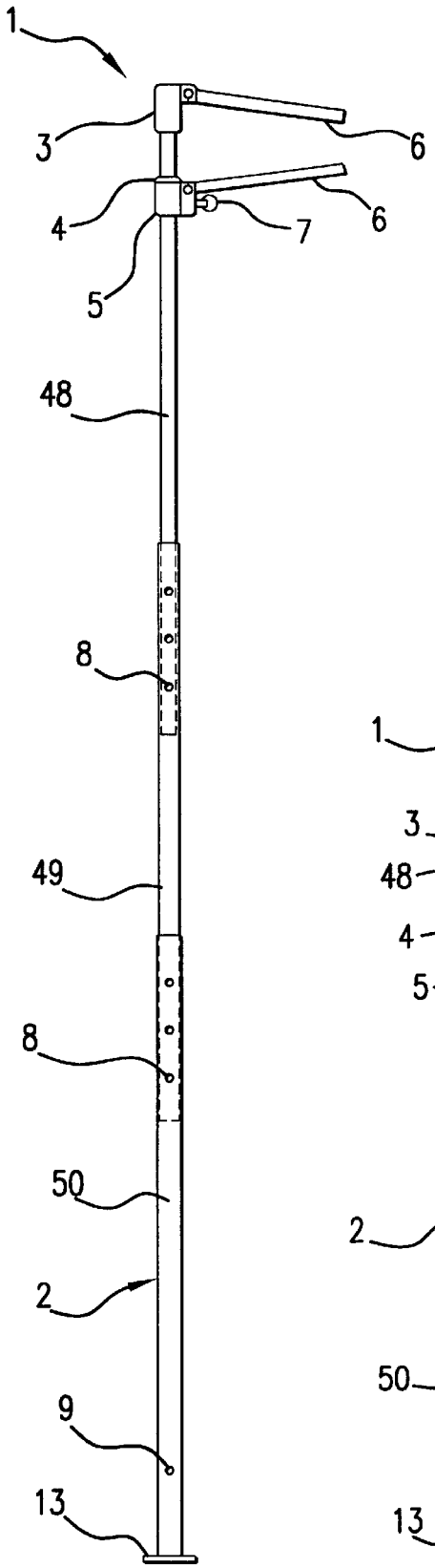
FIGS. 10(*a*), (*b*) and (*c*) are side views of a fifth embodiment of a folding tent frame according to the present invention, with the frame set up in 10(*a*), the poles withdrawn in 10(*b*) and the poles folded in 10(*c*).
Figure 10B:
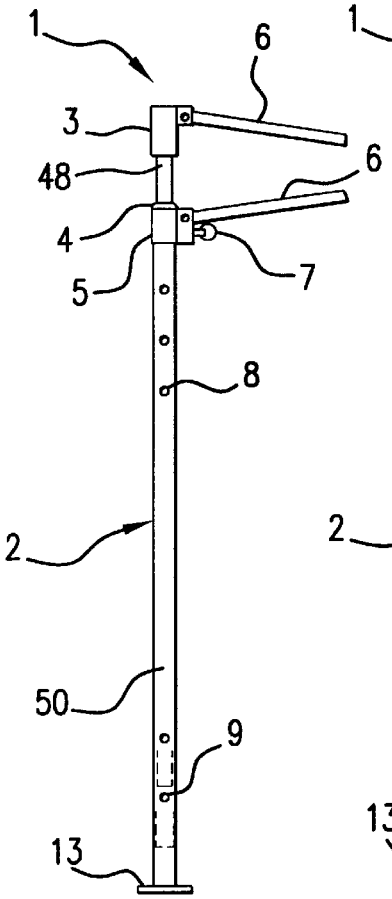
Figure 10C:
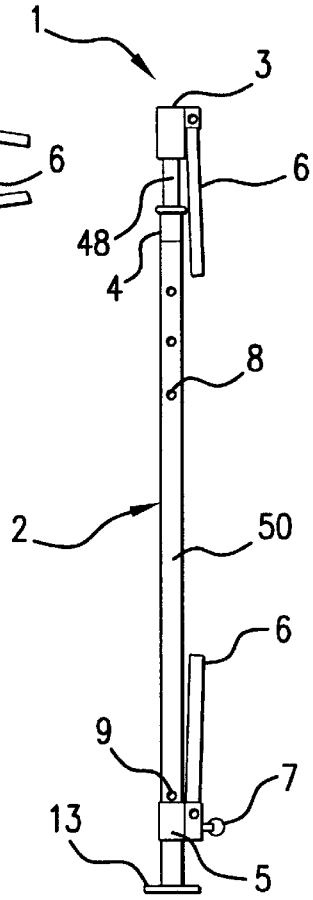
Figure 11:
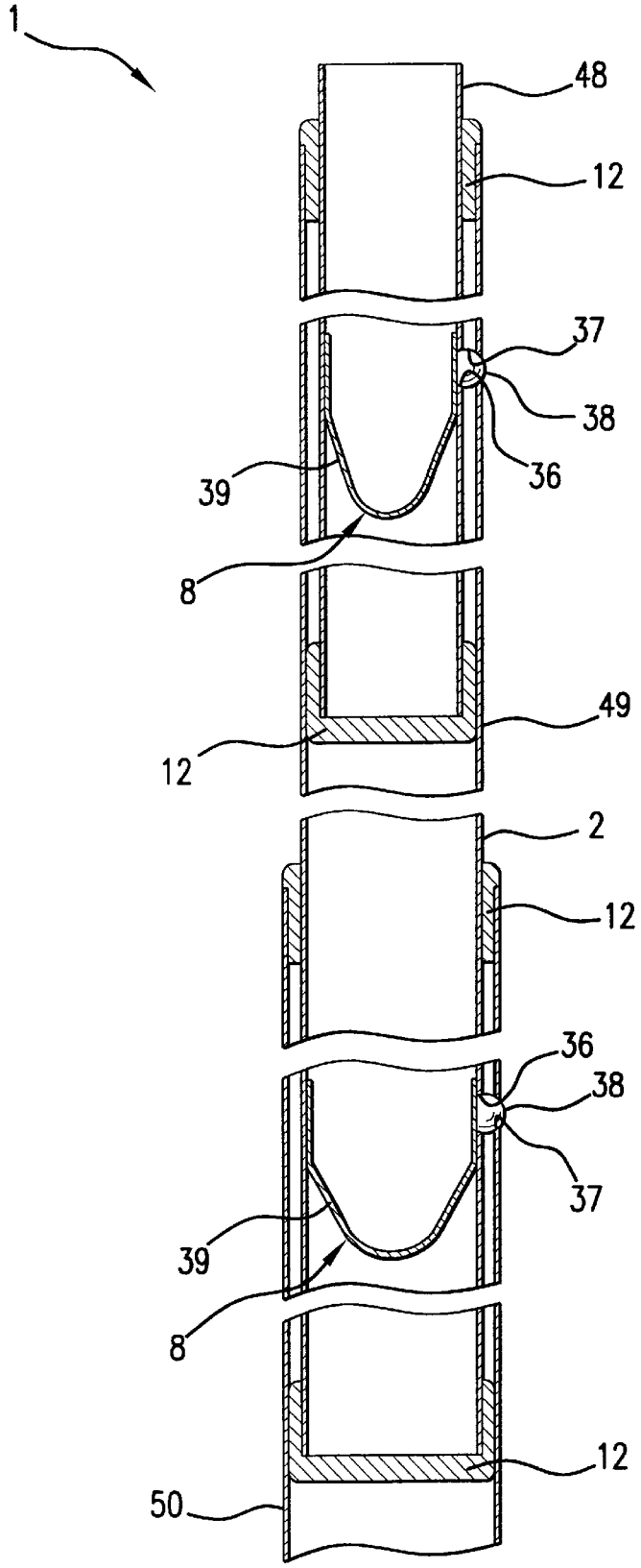
FIG. 11 is a vertical sectional view of a middle part of the frame shown in FIG. 10(*a*).
Figure 12:
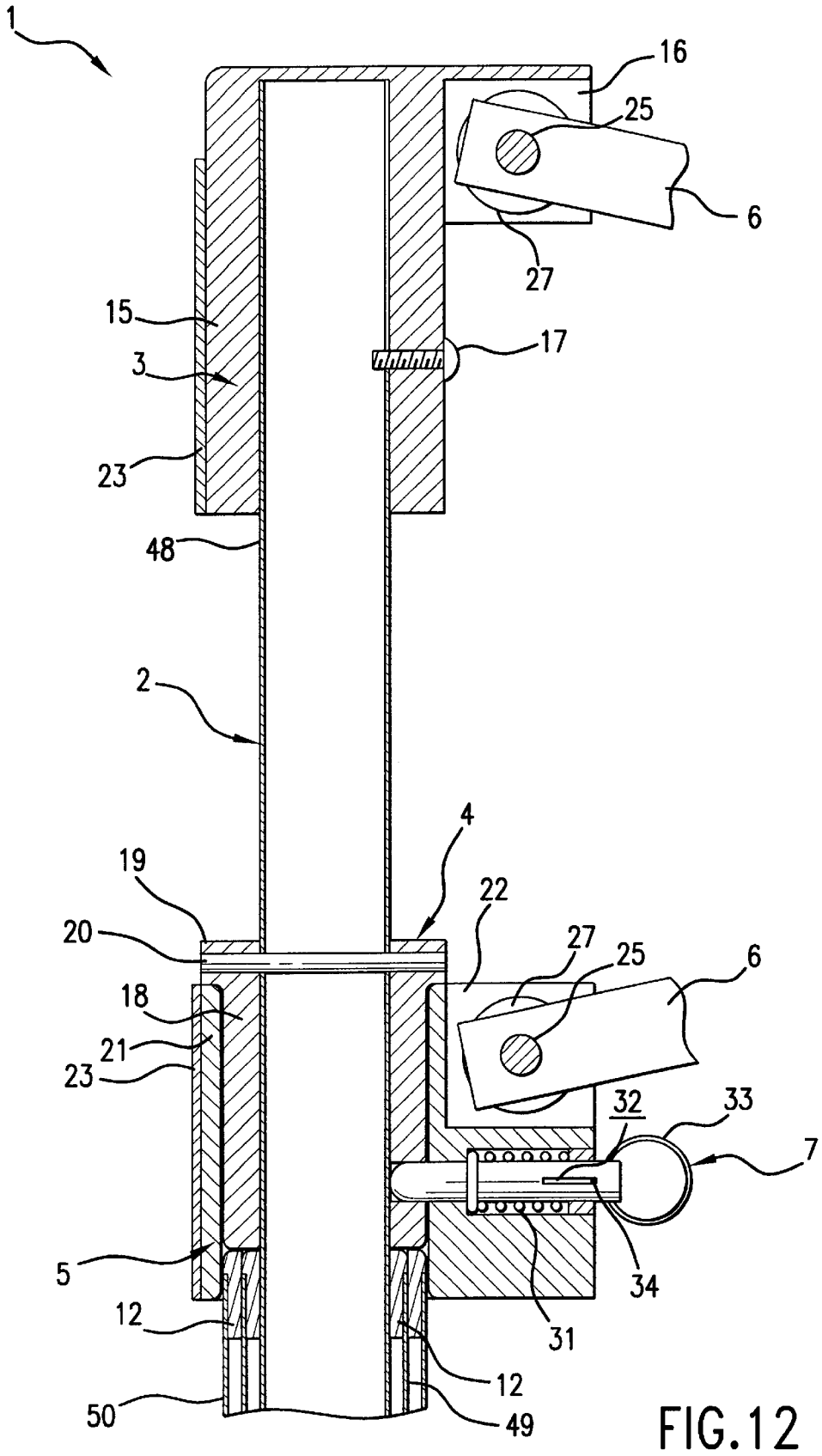
FIG. 12 is a vertical sectional view of an upper part of the frame shown in FIG. 10(*b*).

The folding tent frame 1 of this construction is set up as shown in FIG. 10(*a*). To collapse the frame, the poles are first withdrawn as in FIG. 1(*b*) and then as in FIG. 1(*c*).

The upright pole set 2 is made up of two or three poles in the examples just described. That is not restrictive. The number of poles may be four or more.

The holding means 32 is formed of projection 34 and groove 35. That is not restrictive. The holding means 32 may be formed in any other equivalent way.

In the preceding example, the wheel 42 is provided at the lower end of the second lowest pole, or middle pole 49. That is not restrictive. The wheel 42 may be provided at the lower end of the lowest pole of the upright pole set 2, for example.

The wheel 42 in the preceding example does not swivel. The present invention is not limited to that. A wheel 42 that swivels like a caster may be used. Also, a wheel 42 with a brake may be used.

As set forth above, the present invention provides folding tent frames that offer the following advantages:

(1) The tent frame according to the invention has improved strength and stability. The folding tent frame according to the present invention is formed of upright pole sets, fixed couplers, stopper, and movable couplers. The stopper is provided on the upper pole (or, if there are more than two poles, the uppermost pole) at a position lower than the fixed coupler, such that the stopper prevents the lowest pole from moving up beyond the stopper and can be juxtaposed and continuous with the lowest pole. Also, the movable coupler is so arranged as to slide along the stopper and the lowest pole and not to move up beyond the stopper. And the lower poles are larger than successive upper poles in sectional area.

(2) The tent frame according to the invention has simple construction and low costs. The stopper is provided on the uppermost pole at a position lower than the fixed coupler, such that the stopper prevents the lowest pole from moving up beyond the stopper and can be juxtaposed and continuous with the lowest pole. Also, the movable coupler is so arranged as to slide along the stopper and the lowest pole and not to move up beyond the stopper. And the lower pole is larger than the upper pole in sectional area.

While the present invention has been described in terms of several preferred embodiments, one of ordinary skill in the art will recognize that additions, deletions, substitutions, modifications and improvements can be made while remaining within the scope and spirit of the invention as recited in the attached claims.

List of Reference Numerals

1 folding tent frame
2 upright pole set
3 fixed coupler 3
4 stopper
5 movable coupler
6 traverse frame member
7 movable coupler fastening means
8 extended pole fastening means
9 withdrawn pole fastening means
10, 48 upper poles
11, 50 lower poles
12 sliding piece
13 grounding plate
14 drain hole
15, 18, 21 angle pipe sleeves
16, 22 brackets
17, 20 fasteners
19 flange
23 attaching means
24, 25 horizontal axes
27 washer
28 through hole
29, 37, 40, 43 engaging holes
30, 38, 44 latches
31, 45 springs
32 holding means
33 ring
34 projection
35 groove
36 holding hole
39 leaf spring
41 elastic body
42 wheel
46, 47 inclined surfaces
49 middle pole

What is claimed is:

1. A folding tent frame, comprising:

a plurality of telescopically expandable sets of upright poles, each set of upright poles having at least two poles, a lower pole and an upper pole, each pole having a top and a bottom, the upper pole being smaller than the lower pole in cross section;

a fixed coupler mounted to the top of each upper pole;

a stopper mounted on each upper pole at a position lower than the fixed coupler, said stopper preventing the lower pole from moving up and being juxtaposed completely over the upper pole;

a movable coupler slidable on the stopper and the lower pole and prevented by the stopper from moving up past the stopper;

a plurality of traverse, foldable, scissoring frame members each joined to a fixed coupler and a movable coupler; and a wheel disposed on a pole directly above the lower pole so that the wheel is projectable from the lower pole and contactable with the ground when the poles are withdrawn.

2. A folding tent frame according to claim 1, wherein each upright pole set comprises a set of two poles, an upper pole and a lower pole.

3. A folding tent frame according to claim 2, further comprising a withdrawn pole fastening means provided between the upper and lower poles to hold the poles in a withdrawn state.

4. A folding tent frame according to claim 2, further comprising an elastic body disposed to bias the upper pole from the lower pole.

5. A folding tent frame according to claim 1, wherein the upright pole set comprises a set of three poles, an upper pole, a middle pole and a lower pole, the middle pole having a cross section intermediate between a cross section of the upper pole and a cross section of the lower pole.

6. A folding tent frame according to claim 5, further comprising a withdrawn pole fastening means provided between the upper and lower poles to hold the poles in a withdrawn state.

7. A folding tent frame according to claim 5, further comprising an elastic body provided to bias an upper pole from a lower pole.

8. A folding tent frame of claim 2, wherein the traverse frame members are square in cross section.

9. A folding tent frame of claim 8, further comprising washers integrally provided at ends of the traverse frame members.

10. A folding tent frame of claim 2, further comprising a movable coupler fastening means for fastening the movable coupler at a predetermined position, having:

an engaging hole on the pole;

a latch provided on the movable coupler and engageable with engaging hole;

a spring biasing the latch into engagement with the engaging hole; and holding means for holding the latch in a disengaged position.

11. A folding tent frame of claim 5, wherein the traverse frame members are square in cross section.

12. A folding tent frame of claim 11, further comprising washers integrally provided at ends of the traverse frame members.

13. A folding tent frame of claim 5, further comprising a movable coupler fastening means for fastening the movable coupler at a predetermined position, having:

an engaging hole on the pole;

a latch provided on the movable coupler and engageable with engaging hole;

a spring biasing the latch into engagement with the engaging hole; and holding means for holding the latch in a disengaged position.

14. A folding tent frame of claim 2, further comprising a movable coupler fastening means for fastening the movable coupler at a predetermined position, having:

an engaging hole on the upper pole;

a latch provided on the movable coupler and engageable with engaging hole;

a spring biasing the latch into engagement; and an inclined surface provided on the latch to move the latch to the disengaged position when the inclined surface is pressed onto the lower pole.

15. A folding tent frame of claim 5, further comprising a movable coupler fastening means for fastening the movable coupler at a predetermined position, having:

an engaging hole on the upper pole;

a latch provided on the movable coupler and engageable with engaging hole;

a spring biasing the latch into engagement; and an inclined surface provided on the latch to move the latch to the disengaged position when the inclined surface is pressed onto the lower pole.

16. A folding tent frame of claim 1, further comprising a movable coupler fastening means for fixing the movable coupler on the stopper, the movable coupler fastening means being disposed between the stopper and the movable coupler.

17. A folding tent frame of claim 1, further comprising an extended pole fastening means provided between upper and lower poles for holding the upper and lower poles in an extended state.

18. A folding tent frame, comprising:

a plurality of telescopically expandable sets of upright poles, each set of upright poles having at least two poles, a lower pole and an upper pole, each pole having a top and a bottom, the upper pole being smaller than the lower pole in cross section;

a fixed coupler mounted to the top of each upper pole;

a stopper mounted on each upper pole at a position lower than the fixed coupler, said stopper preventing the lower pole from moving up and being juxtaposed completely over the upper pole;

a movable coupler slidable on the stopper and the lower pole and prevented by the stopper from moving up past the stopper;

a plurality of traverse, foldable, scissoring frame members each joined to a fixed coupler and a movable coupler; and a movable coupler fastening means for fixing the movable coupler on the stopper, the movable coupler fastening means being disposed between the stopper and the movable coupler.

* * * * *